US011629497B2

(12) United States Patent
Chich et al.

(10) Patent No.: US 11,629,497 B2
(45) Date of Patent: Apr. 18, 2023

(54) FASTENER PLATE FOR SECURING AN UNDERLAYMENT TO A ROOF SURFACE

(71) Applicant: BMIC LLC, Dallas, TX (US)

(72) Inventors: Adem Chich, Kearney, NJ (US); Yan Zheng, Livingston, NJ (US); Gerry Messina, Wyckoff, NJ (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 17/956,537

(22) Filed: Sep. 29, 2022

(65) Prior Publication Data

US 2023/0027373 A1 Jan. 26, 2023

Related U.S. Application Data

(63) Continuation of application No. 16/776,971, filed on Jan. 30, 2020, now Pat. No. 11,519,177.

(60) Provisional application No. 62/801,254, filed on Feb. 5, 2019.

(51) Int. Cl.

| | |
|---|---|
| ***E04D 1/36*** | (2006.01) |
| ***E04D 1/00*** | (2006.01) |
| *E04D 1/34* | (2006.01) |

(52) U.S. Cl.

CPC ..... *E04D 1/2914* (2019.08); *E04D 1/36* (2013.01); *E04D 2001/3494* (2013.01)

(58) Field of Classification Search

CPC ... E04D 1/2914; E04D 1/36; E04D 2001/349; E04D 2001/3494; E04D 2001/3423; E04D 2001/3426; E04D 2001/3429; E04D 5/145; E04D 12/002

See application file for complete search history.

(56) References Cited

U.S. PATENT DOCUMENTS 1,435,134 A * 11/1922 Boley ..... E04D 5/145 411/487
2,048,093 A * 7/1936 Alpeters ..... E04D 5/145 411/923
2,207,897 A * 7/1940 Schaus ..... F16B 15/06 411/456

(Continued)

FOREIGN PATENT DOCUMENTS

DE 202012006047 U1 8/2012
DE 202012006047 U1 * 9/2012 ..... E04D 5/145

(Continued)

*Primary Examiner* — Ryan D Kwiecinski

(74) *Attorney, Agent, or Firm* — Womble Bond Dickinson (US) LLP

(57) ABSTRACT

A fastener plate for use in coupling an underlayment to a roof surface is disclosed. In use, the fastener plate is arranged and configured to enable subsequently applied liquid coatings to flow through a top surface of the fastener plate and into one or more cavities so that the liquid coating seals any openings created by introduction of the fastener. In one embodiment, the fastener plate may include a top surface, a bottom surface, a fastener opening for receiving a fastener, a plurality of openings formed in the top surface, and one or more cavities positioned between the top surface and the bottom surface, the one or more cavities being in fluid communication with the plurality of openings so that the liquid coating can flow through the plurality of openings formed in the top surface and into the one or more cavities to seal any voids created by the fastener.

20 Claims, 12 Drawing Sheets

(56) References Cited

U.S. PATENT DOCUMENTS 4,520,606 A * 6/1985 Francovitch ..... E04D 5/145 52/509
4,620,402 A 11/1986 Beneze
4,744,187 A * 5/1988 Tripp ..... F16B 37/14 52/410
4,780,039 A * 10/1988 Hartman ..... F16B 43/00 411/533
5,082,412 A * 1/1992 Thomas ..... F16B 43/001 411/533
5,094,056 A * 3/1992 Peters ..... F16B 21/183 52/410
5,118,235 A * 6/1992 Dill ..... E04D 3/3603 411/908
6,349,519 B1 2/2002 Beller
6,665,991 B2 * 12/2003 Hasan ..... E04D 5/14 411/545
6,722,095 B2 * 4/2004 Kobetsky ..... E04D 5/145 52/410
D590,702 S * 4/2009 Giddings ..... D8/382
8,166,720 B2 * 5/2012 Garrigus ..... F16B 43/00 52/410
8,336,275 B2 * 12/2012 Rodenhouse ..... E04F 13/045 52/363
8,549,793 B1 10/2013 Gens et al.
D696,932 S * 1/2014 Rodenhouse ..... D8/399
8,863,441 B2 10/2014 Murrey
D748,973 S * 2/2016 Rodenhouse ..... D8/399
9,587,740 B2 3/2017 Luick et al.
9,719,551 B2 * 8/2017 Gere ..... E04D 5/145
9,945,414 B1 * 4/2018 Rodenhouse ..... F16B 43/001
10,221,563 B2 * 3/2019 Miks ..... E04B 1/7633
11,035,130 B1 6/2021 Arguelles
11,434,638 B2 9/2022 Chich et al.
11,519,177 B2 12/2022 Chich et al.
2012/0311951 A1 12/2012 Letts et al.
2013/0167455 A1 7/2013 Jenkins et al.
2016/0348327 A1 12/2016 Martin et al.
2021/0095475 A1 * 4/2021 Zheng ..... E04D 5/145

FOREIGN PATENT DOCUMENTS

DE 202012006047 U1 9/2012
DE 102017011043 A1 * 5/2019
DE 102017011043 A1 5/2019
DE 102017011043 A1 5/2019

* cited by examiner

FASTENER PLATE FOR SECURING AN UNDERLAYMENT TO A ROOF SURFACE

CROSS-REFERENCE TO RELATED APPLICATIONS

This is a continuation of U.S. patent application Ser. No. 16/776,971, filed Jan. 30, 2020, entitled "Fastener Plate for Securing an Underlayment of a Roof Surface", which claims the benefit of U.S. provisional patent application Ser. No. 62/801,254, filed Feb. 5, 2019, entitled "Fastener Plate for Securing an Underlayment to a Roof Surface," which application are incorporated in their entirety by reference herein.

FIELD OF THE DISCLOSURE

The present disclosure relates generally to roofing systems, and more particularly to improved fastener plates for securing an underlayment to a roof surface, the structure of the fastener plate enabling a subsequently applied liquid coating to flow therein to provide a complete seal.

BACKGROUND OF THE DISCLOSURE

It is generally known in the art to apply a liquid coating such as, for example, a silicone coating or the like, to a roof surface for moisture protection. In some applications, such as, for example, mechanically fastened liquid-applied roofing systems, an underlayment such as, for example, a polypropylene or synthetic underlayment, may be initially secured to the roof surface via, for example, fasteners such as, for example, screws, nails, etc. In addition, a fastener plate may be used to better secure the underlayment to the roof surface. In use, fasteners extend through an opening formed in such fastener plates, through the underlayment and into the roof surface.

Installation of fasteners into the roof surface however create pathways, voids, spaces, etc. for moisture to enter the roof surface. As such, these pathways, voids, spaces, etc. (used interchangeably herein without the intent to limit) should be properly sealed by the liquid coating to prevent the introduction of moisture into the roof surface.

Currently, fastener plates suffer in that they are not properly designed to ensure that enough liquid coating can seal the area around the fastener and the pathway created by the introduction of the fastener. That is, one disadvantage with known fastener plates is that they do not provide structures that enable a sufficient amount of coating to properly seal the spaces created by the introduction of the fasteners used to secure the underlayment to the roof surface. For example, when using a silicone based liquid coating, fastener plates are generally omitted because they are not designed to permit the silicone based liquid coating to seal the area around the fastener and the pathway created by the introduction of the fastener.

It would be desirable to provide an improved fastener plate for coupling an underlayment to a roof surface. In particular, it would be beneficial to design a fastener plate that can be used with silicone-based liquid coatings.

SUMMARY OF THE DISCLOSURE

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

In one embodiment, disclosed herein is a fastener plate arranged and configured to facilitate efficient flow of subsequently applied liquid coatings to ensure the area around the fastener and the pathway created by the introduction of the fastener is properly sealed to prevent, or at least inhibit, the introduction of moisture into the roof surface.

In one example embodiment, the fastener plate includes a top surface, a bottom surface, a fastener opening adapted and configured to receive a fastener for coupling the fastener plate to an underlayment and a roof surface, a plurality of openings formed in the top surface, and one or more cavities positioned between the top surface and the bottom surface, the one or more cavities being in fluid communication with the plurality of openings so that subsequently applied liquid coating can flow through the plurality of openings formed in the top surface and into the one or more cavities to seal any voids created by the fastener.

In one embodiment, the fastener plate includes a plurality of projections extending from the top surface towards the bottom surface thereof, the plurality of projections being arranged and configured to prevent compression of the top surface towards the bottom surface.

In one embodiment, the projections may include a bottom edge arranged and configured to contact the underlayment.

In one embodiment, the bottom edge of the projections include a rounded end portion to enable the projections to contact the underlayment without cutting into the underlayment.

In one embodiment, the plurality of projections are arranged in a first circumferentially disposed set of projections and a second circumferentially disposed set of projections. In one embodiment, the first and second circumferentially disposed set of projections each include a plurality of discontinuous and separate projections spaced apart from each other by a gap. In one embodiment, the gaps of the first circumferentially disposed set of projections is offset relative to the gaps of the second circumferentially disposed set of projections.

In one embodiment, the fastener opening is countersunk so that the subsequently applied liquid coating covers an area above a head portion of the fastener. In addition, the fastener opening may be arranged and configured so that an area surrounding the head portion of the fastener is covered by the subsequently applied liquid coating.

In one embodiment, the fastener plate further comprises a stiffened region positioned about the fastener opening, the stiffened region being arranged and configured to minimize compression of the fastener plate.

In one embodiment, the stiffened region is arranged and configured to minimize compression of the top surface towards the bottom surface.

In one embodiment, the fastener opening and the stiffened region are centrally positioned within the fastener plate.

In one embodiment, the stiffened region includes a plurality of projections positioned circumferentially about the fastener opening, the plurality of projections being sufficiently rigid to minimize compression of the top surface due to tightening of a fastener within the fastener opening.

In one embodiment, the plurality of projections extend below the bottom surface of the fastener plate so that the plurality of projections are arranged and configured as a load bearing point.

In one embodiment, at least one of the plurality of openings formed in the top surface is positioned along an outer perimeter of the fastener plate.

In one embodiment, the fastener plate includes a circular, domed shaped profile.

In one embodiment, the fastener plate includes a rectangular shaped profile having first and second open side edges.

In one embodiment, the fastener plate further comprises a layer of mesh material coupled to the fastener plate.

In one embodiment, the bottom surface of the fastener plate includes an inwardly projecting lip extending from an outer side edge thereof.

In one embodiment, the bottom surface includes a rounded edge portion.

Embodiments include underlayments coupled to a roof surface with one or more fasteners as described herein. Other embodiments include methods of coupling an underlayment to a roof surface with one or more fasteners as described herein. Other embodiments include a roof system that includes a structure comprising an underlayment coupled to a roof surface with one or more fasteners as described herein, and a liquid coating applied to the structure. Yet other embodiments include methods of making a roof system that includes a structure comprising an underlayment coupled to a roof surface with one or more fasteners as described herein, and a liquid coating applied to the structure.

BRIEF DESCRIPTION OF THE DRAWINGS

By way of example, a specific embodiment of the disclosed device will now be described, with reference to the accompanying drawings, in which.

Figure 1A:
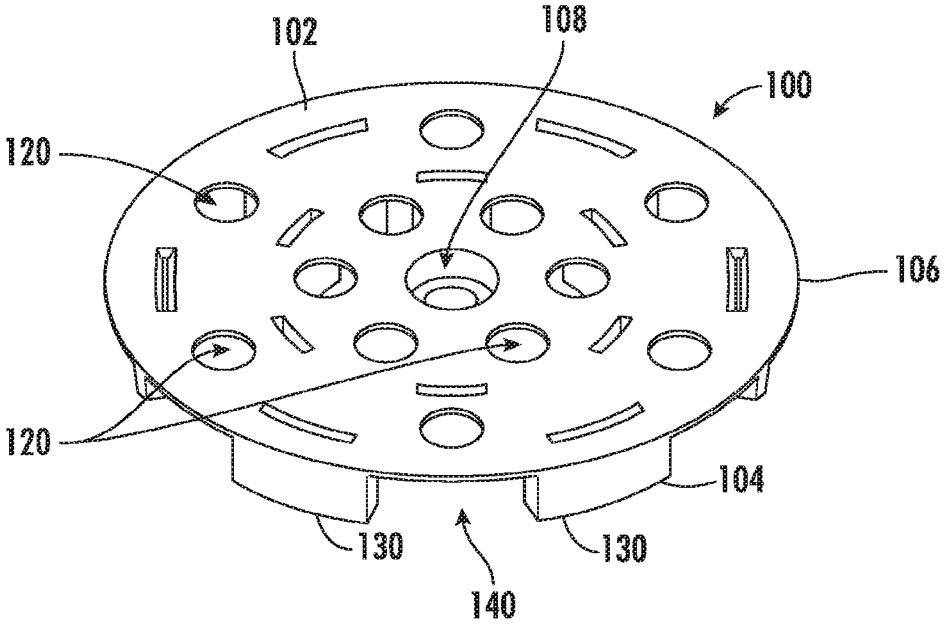
FIG. 1A is a top, perspective view of an embodiment of a fastener plate in accordance with one or more aspects of the present disclosure.
Figure 1B:
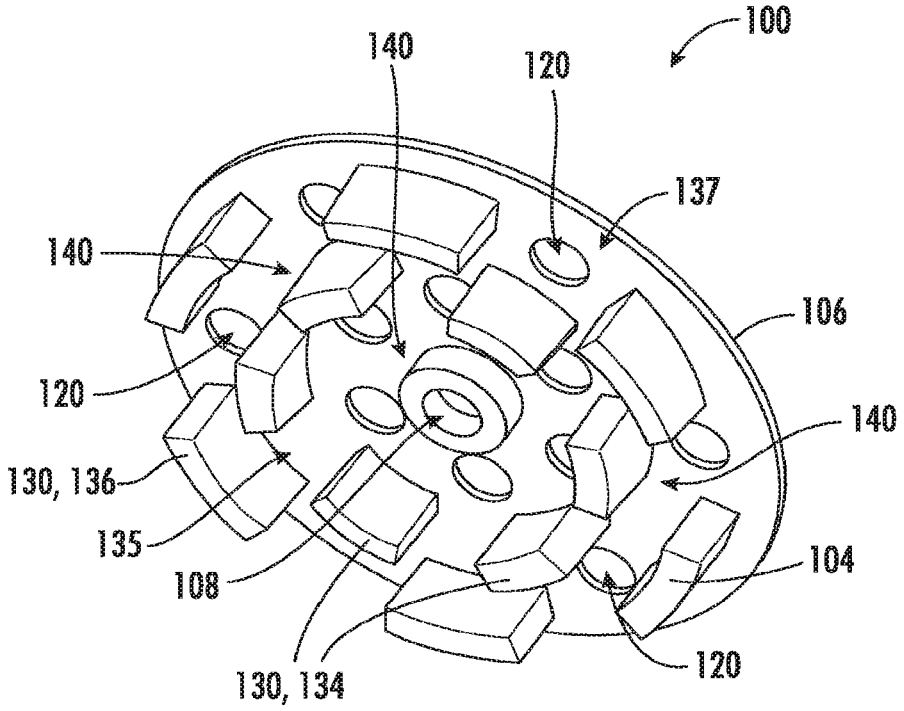
FIG. 1B is a bottom, perspective view of the fastener plate shown in FIG. 1A.
Figure 1C:
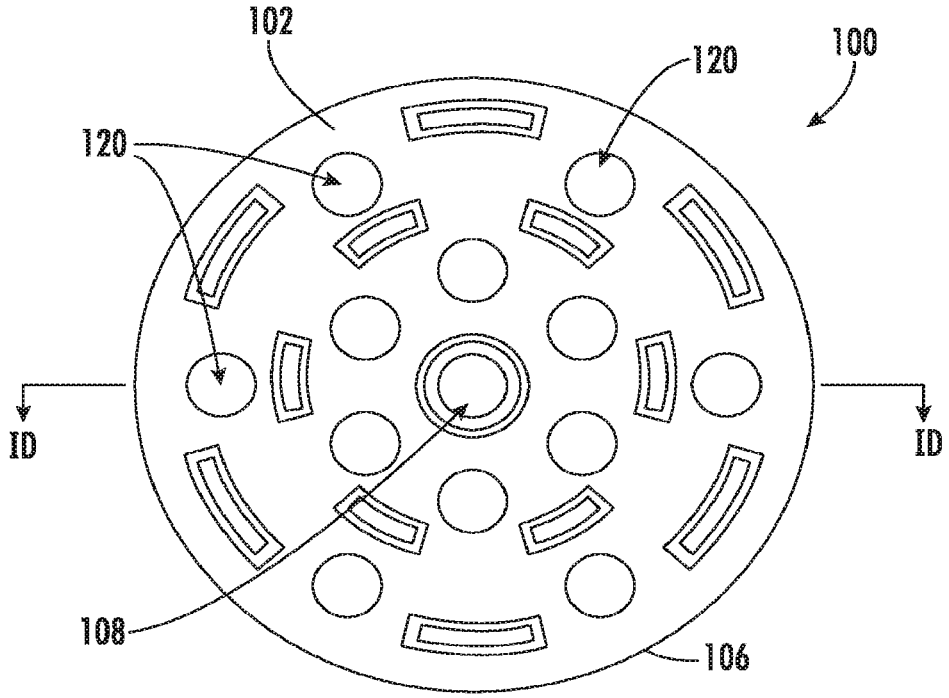
FIG. 1C is a top view of the fastener plate shown in FIG. 1A.

The drawings are not necessarily to scale. The drawings are merely representations, not intended to portray specific parameters of the disclosure. The drawings are intended to depict example embodiments of the disclosure, and therefore are not be considered as limiting in scope. In the drawings, like numbering represents like elements.

DETAILED DESCRIPTION

Numerous embodiments of an improved fastener plate in accordance with the present disclosure will now be described more fully hereinafter with reference to the accompanying drawings, in which embodiments of the present disclosure are presented. The fastener plate of the present disclosure may, however, be embodied in many different forms and should not be construed as being limited to the embodiments set forth herein. Rather, these embodiments are provided so that this disclosure will convey certain aspects of the fastener plate to those skilled in the art. In the drawings, like numbers refer to like elements throughout unless otherwise noted.

As will be described in greater detail below, in accordance with one aspect of the present disclosure, an improved fastener plate for use in coupling an underlayment to a roof surface is disclosed. In one embodiment, the fastener plate includes features arranged and configured to create openings and cavities to facilitate flow of subsequently applied liquid coating to ensure the area around the fastener and the pathway created by the introduction of the fastener is properly sealed to prevent, or at least inhibit, the introduction of moisture into the roof surface.

Generally speaking, as will be appreciated by one of ordinary skill in the art, in use, an underlayment may be installed onto a roof surface, deck, substrate, etc. (used interchangeably herein without the intent to limit). One commercially available underlayment includes Tiger Paw™ UV-stabilized polypropylene underlayment provided by GAF® Materials Corporation. Alternatively, another commercially available underlayment includes Adfors W4520 or W4503 roofing reinforcement.

In use, the underlayment may be coupled to the underlying roof surface by any mechanism now known or hereafter developed including, for example, mechanical fasteners (nails, staples, screws, etc.).

Thereafter, a liquid coating may be applied onto the underlayment. The liquid coating can be any liquid coating now known or hereafter developed including, for example, a coating comprising silicone, an acrylic, a polyurethane, an epoxy, a poly(methyl methacrylate) (PMMA), STP, or the like. For example, in one embodiment, one commercially available coating includes Unisil HS silicone roof coating provided by GAF® Materials Corporation. In use, the liquid coating can be applied to a top surface of the underlayment by any mechanism now known or hereafter developed including, for example, spraying, rolling, brushing, etc.

In order to properly protect the roof surface from moisture damage via the introduction of unwanted moisture, any voids, spaces, or pathways (used interchangeably herein without the intent to limit) should be properly sealed by the liquid applied coating. That is, the liquid applied coating should seal and protect the roof surface from the introduction of moisture through any unwanted voids including, for example, any pathways created by the introduction of the fasteners for securing the underlayment to the roof surface.

Figure 1D:
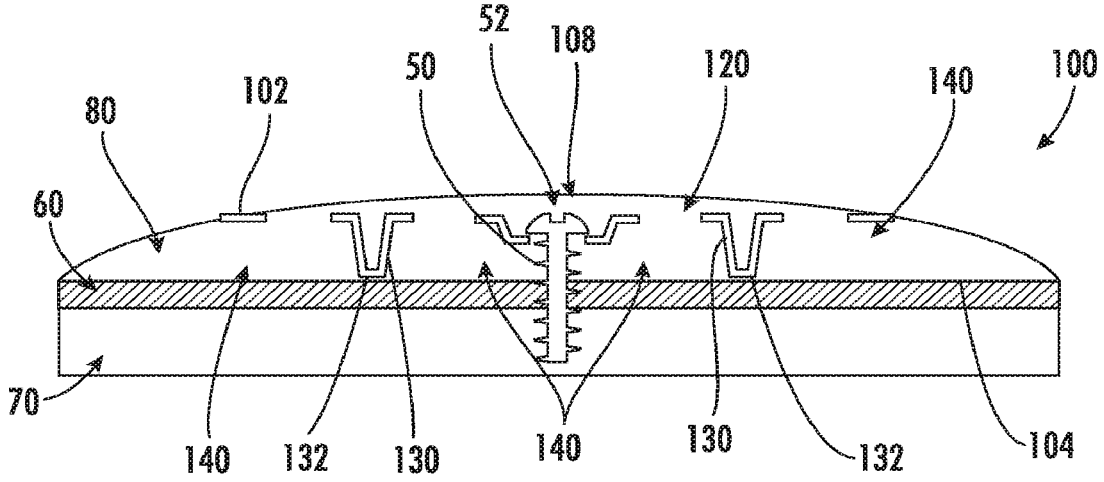
FIG. 1D is a cross-sectional view of the fastener plate shown in FIG. 1A, taken along line ID-ID in FIG. 1C.

Referring to FIGS. 1A-1D, one embodiment of an improved fastener plate 100 is disclosed. In use, the fastener plate 100 can be used to couple an underlayment 60 (FIG. 1D) to a roof surface 70 (FIG. 1D). As will be described in greater detail, in one embodiment, the fastener plate 100 is arranged and configured with one or more features to enable subsequently applied liquid coating 80 (FIG. 1D) to pass through the fastener plate 100 to seal against the fastener 50 (FIG. 1D) used to couple the underlayment 60 the roof surface 70.

Figure 2A:
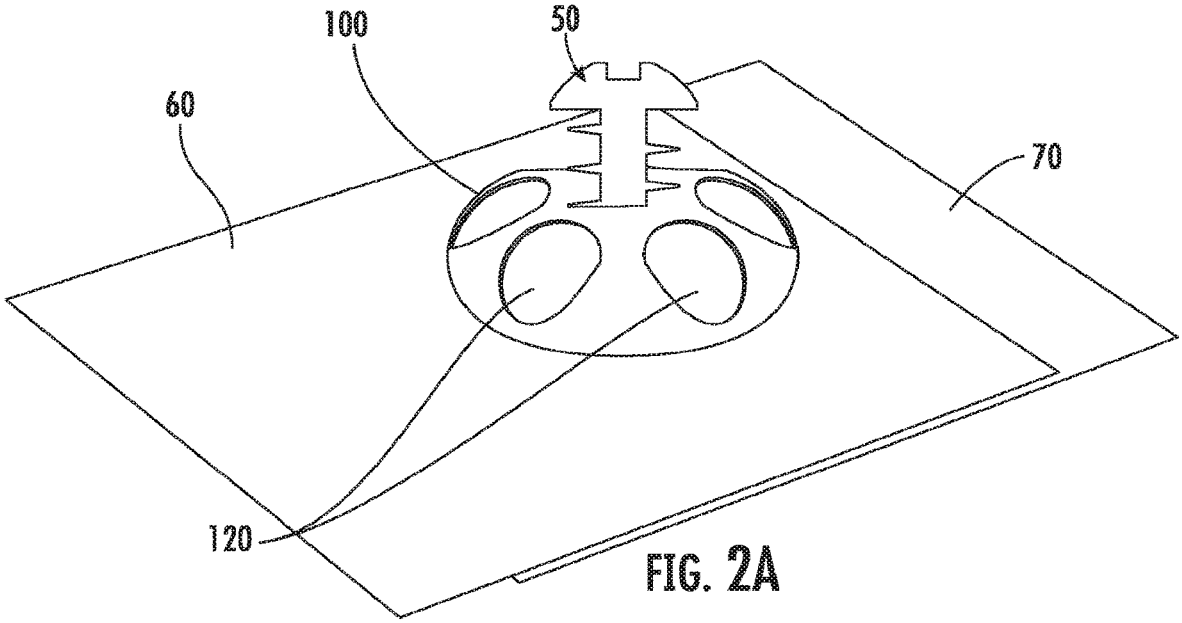
FIG. 2A is a top, perspective view of an alternate embodiment of a fastener plate in accordance with one or more aspects of the present disclosure.
Figure 2B:
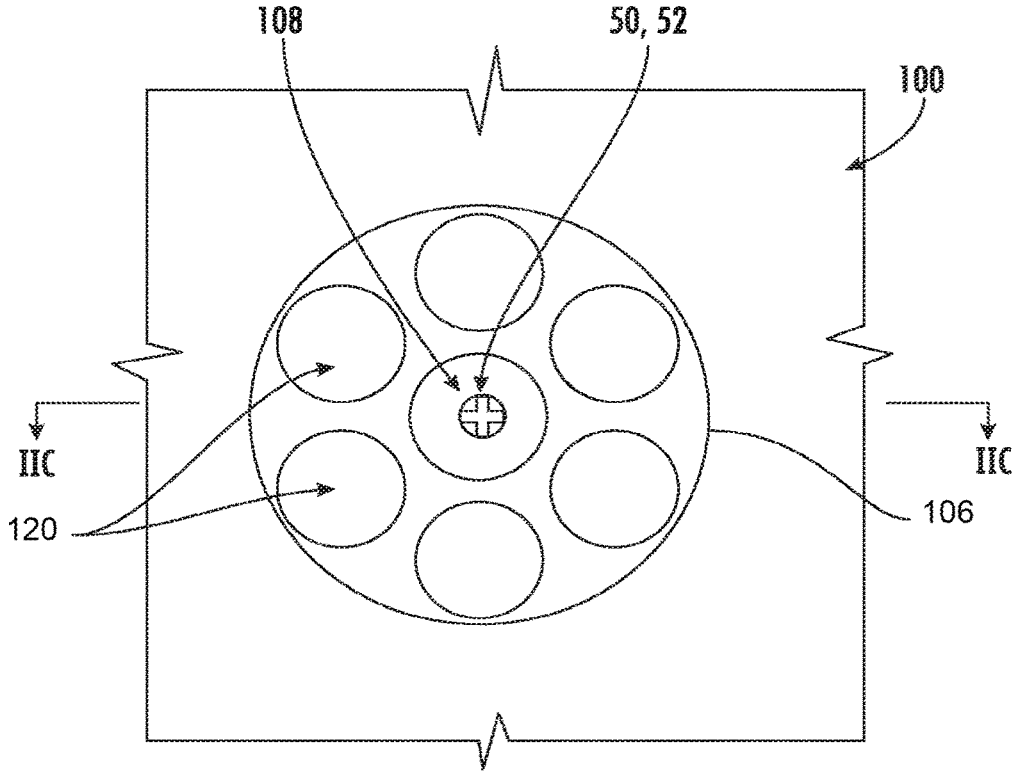
FIG. 2B is a top view of fastener plate shown in FIG. 2A.

As illustrated, the fastener plate 100 includes a top surface or portion 102 (used interchangeably herein without the intent to limit), a bottom surface (e.g., an underlayment contacting surface) 104, and an outer edge surface or perimeter 106. In use, the top surface 102 is spaced apart from the bottom surface 104 so that one or more cavities 140, as will be described in greater detail below, are formed between the top surface 102 and the bottom surface 104 of the fastener plate 100. The bottom surface 104 may be an open-ended bottom surface (e.g., including one or more projections for contacting the underlayment) (schematically shown in FIGS. 1A-1D) or may be in the form of a closed-ended bottom surface with one or more openings formed therein (schematically shown in FIGS. 2A-2C). Thus arranged, referring to FIG. 2C, in one embodiment, the fastener plate 100 may include a plurality of spacers 180 on the bottom surface 104 thereof. In use, the spacers 180 contact the top surface of the underlayment 60. In use, the spacers 180, may define the bottom surface 104 of the plate 100. As such, the spacers 180 prevent, or at least minimize, the fastener plate 100 from damaging (e.g., cutting) the underlying fabrics such as, for example, the underlayment 60, waterproof layer, etc. In use, the spacers 180 can be arranged and configured in any manner so long as they prevent, or at least minimize, the fastener plate 100 from damaging (e.g., cutting) the underlying fabrics (e.g., eliminate, reduce, etc. any sharp components from cutting into the underlying fabrics such as, the underlayment 60). For example, the spacers 180 may be an attachment component such as, for example a glued piece, or the like. Alternatively, the spacers 180 may be or form part of the bottom surface 104 of the fastener plate 100 such as, for example, a stamped foot or the like.

In addition, the fastener plate 100 includes one or more fastener openings 108 in the top surface 102 thereof for receiving one or more fasteners 50 for securing the fastener plate 100 to the underlayment 60 and roof surface 70. Thus arranged, in use, the fastener 50 and the fastener plate 100 couple, secure, attach, etc. (used interchangeably herein without the intent to limit) the underlayment 60 to the roof surface 70.

As illustrated, the fastener plate 100 may include a circular shape, however, as will be described and illustrated in greater detail below, the fastener plate 100 may have any shape including, for example, oval, square, rectangular, etc. In one embodiment, the fastener plate 100 may include a dome shape (e.g., height in center adjacent to the fastener opening 108 is greater than the height at the outer edge or perimeter 106) so that, as will be described in greater detail, the center area (e.g., area where the fastener 50 passes through) is surrounded with a thicker layer of subsequently applied liquid coating 80.

As illustrated, the fastener plate 100 also includes a plurality of openings 120 extending through the top surface 102 thereof. In use, the openings 120 are sized and configured to enable subsequently applied coating 80 to pass through the fastener plate 100 and into contact with, for example, the fastener 50 and the underlayment 60. That is, in one embodiment, the openings 120 are arranged and configured to enable liquid coatings 80 including, for example, silicone-based liquid coatings, to flow sufficiently through the top surface 102 of the fastener plate 100. As illustrated in FIGS. 1A-1D, the openings 120 may be circular openings. However, the openings 120 may have any size and shape, and may be provided in any numbers and may be are arranged and configured in any manner to enable subsequently applied coating 80 to pass through the top surface 102 of the fastener plate 100 and into cavities 140 formed underneath. For example, the fastener plate 100 may include between 3 and 18 openings 120, although more or less openings are envisioned. In one embodiment, it is envisioned that the total cumulative size of the openings will be between 10% to 90% of the total surface area of the fastener plate. In one embodiment, it is envisioned that the total cumulative size of the openings will be between 20% to 90% of the total surface area of the fastener plate. In one embodiment, it is envisioned that the total cumulative size of the openings will be between 30% to 90% of the total surface area of the fastener plate. In one embodiment, it is envisioned that the total cumulative size of the openings will be between 50% to 90% of the total surface area of the fastener plate. In one embodiment, it is envisioned that the total cumulative size of the openings will be between 70% to 90% of the total surface area of the fastener plate. In one embodiment, it is envisioned that the total cumulative size of the openings will be between 10% to 80% of the total surface area of the fastener plate. In one embodiment, it is envisioned that the total cumulative size of the openings will be between 10% to 50% of the total surface area of the fastener plate. In one embodiment, it is envisioned that the total cumulative size of the openings will be between 10% to 40% of the total surface area of the fastener plate. In one embodiment, it is envisioned that the total cumulative size of the openings will be between 10% to 30% of the total surface area of the fastener plate. In one embodiment, the total cumulative size of the openings will be between 25% and 75% of the total surface area of the fastener plate, although more or less is envisioned.

In addition, the fastener plate 100 may include a plurality of projections 130 extending from the top surface 102 thereof. In use, the projections 130 form one or more cavities 140 between the top surface 102 of the fastener plate 100 and the underlayment 60 for receiving subsequently applied liquid coating 80. In use, the cavities 140 formed by the projections 130 are arranged and configured to maintain a desired thickness of subsequently applied coating 80 (e.g., height of cavities 140 should be sufficient to enable the subsequently applied liquid coating 80 to flow therein). In one embodiment, it is envisioned that the height to diameter ratio of the fastener plate 100 will be approximately 0.5. In an alternate embodiment, the height to diameter ratio of the fastener plate 100 may be approximately 0.25. In an alternate embodiment, the height to diameter ratio of the fastener plate 100 may be approximately 0.3. In an alternate embodiment, the height to diameter ratio of the fastener plate 100 may be approximately 0.4. In an alternate embodiment, the height to diameter ratio of the fastener plate 100 may be approximately 0.6. In an alternate embodiment, the height to diameter ratio of the fastener plate 100 may be approximately 0.8. In an alternate embodiment, the height to diameter ratio of the fastener plate 100 may be approximately 0.9. As such, a four-inch plate may have a one-inch height, although other dimensions/ratios are envisioned.

Figure 3A:
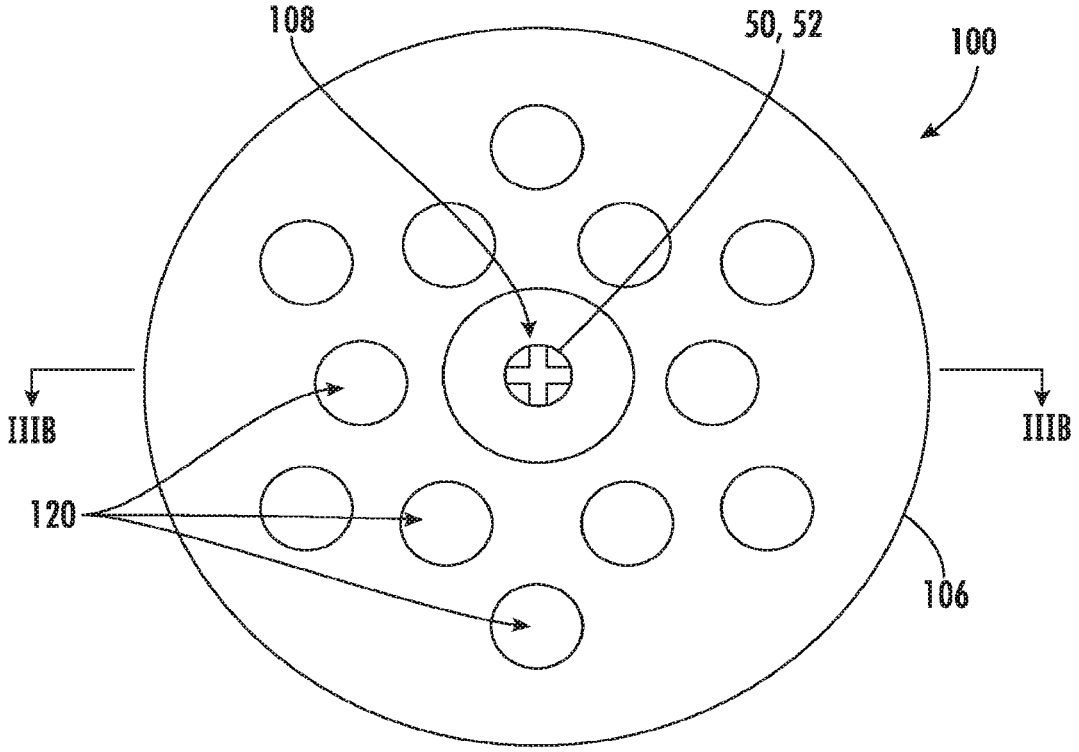
FIG. 3A is a top view of an alternate embodiment of a fastener plate in accordance with one or more aspects of the present disclosure.
Figure 3B:
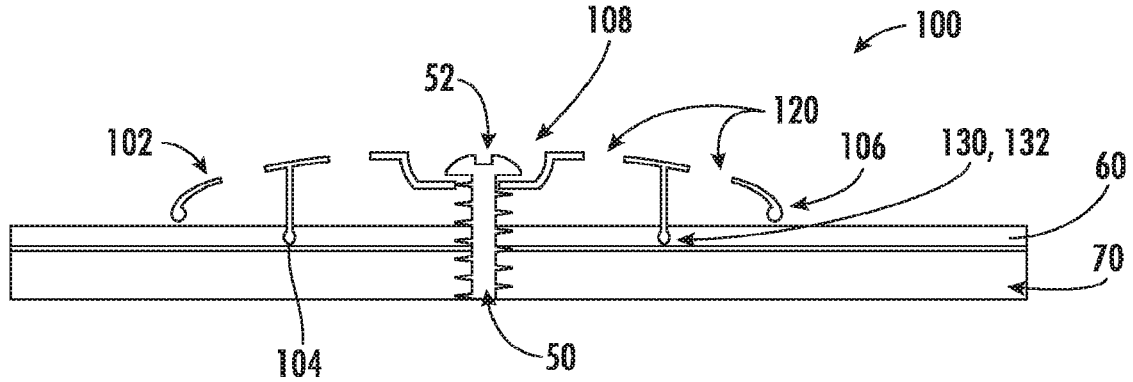
FIG. 3B is a cross-sectional view of the fastener plate shown in FIG. 3A, taken along line IIIB-3B in FIG. IIIA.

In one embodiment, as schematically shown in FIG. 3B, the projections 130 may include a bottom edge 132 adapted and configured to contact the underlayment 60. For example, the bottom edge 132 of the projections 130 may include a rounded or spherical end portion to enable the projections 130, and hence the fastener plate 100, to contact the underlayment 60 without cutting into or piercing the underlayment 60 during, for example, tightening of the fastener 50. In use, the projections 130 may also be arranged and configured to prevent compressing of the fastener plate 100 and thus closing of the cavities 140 formed therein during, for example, tightening of the fastener 50.

Referring to FIGS. 1A-1D, when used with a circularly-shaped fastener plate, the projections 130 may be circumferentially disposed about an area of the plate 100. In addition, the fastener plate 100 may include two sets of circumferentially disposed projections 130 (e.g., inner and outer sets or groups of circumferentially disposed projections 134, 136), although it is envisioned that the fastener plate 100 may include more or less sets of projections 130 including, one, three, four, or more. In use, as illustrated, the individual projections 130 in each set of projections 134, 136 are discontinuous so that adjacent projections 130 are separated from each other by gaps 135, 137. In addition, as illustrated, in one embodiment, the projections 130 and gaps 135 of a first set of projections 134 may be offset or misaligned relative to the projections 130 and gaps 137 of a second set of projections 136. In this manner, a longer, more curvaceous pathway is created to better protect against the introduction of moisture from the outer edge surface or perimeter 106.

As shown, for example, in FIGS. 1A-1D, 2B, 2C, 3A, 3B, and 4B, the fastener opening 108 may be countersunk so that, in use, an area above a head 52 of the fastener 50 may be sealed (e.g., covered) by subsequently applied liquid coating 80. In addition, the fastener opening 108 may be arranged and configured so that an area surrounding the head 52 of the fastener 50 is also sealed (e.g., covered) by subsequently applied liquid coating 80. In this manner, the entire area surrounding the fastener 50 may be sealed by subsequently applied liquid coating 80. In one embodiment, the head 52 of the fastener 50 may be sunken by up to half or more of the height of the opening 108 to allow effective filling of both the head 52 of the fastener 50 and the body of the fastener 50. In addition, it should be understood that while a single fastener opening is disclosed and illustrated, the fastener plate may include multiple fastener openings. Additionally, the fastener openings may be located anywhere in the fastener plate.

By incorporating a plurality of openings 120 and a plurality of projections 130 forming a plurality of cavities 140, the fastener plate 100 is arranged and configured to enable subsequently applied liquid coating 80 to pass through the top surface 102 of the fastener plate 100 and into the cavities 140 defined by the projections 130. In addition, by incorporating a countersunk fastener opening 108, the fastener plate 100 is arranged and configured to enable subsequently applied liquid coating 80 to cover and seal against the head 52 of the fastener 50. Thus arranged, the fastener plate 100 ensures efficient filling of the cavities 140 with the coating 80 and efficient filling of the pathway formed by the introduction of the fastener 50 into the underlayment 60 and the roof surface 70, thus ensuring proper sealing of the roof surface 70 from the introduction of moisture through the space created by the introduction of the fasteners 50.

Figure 4A:
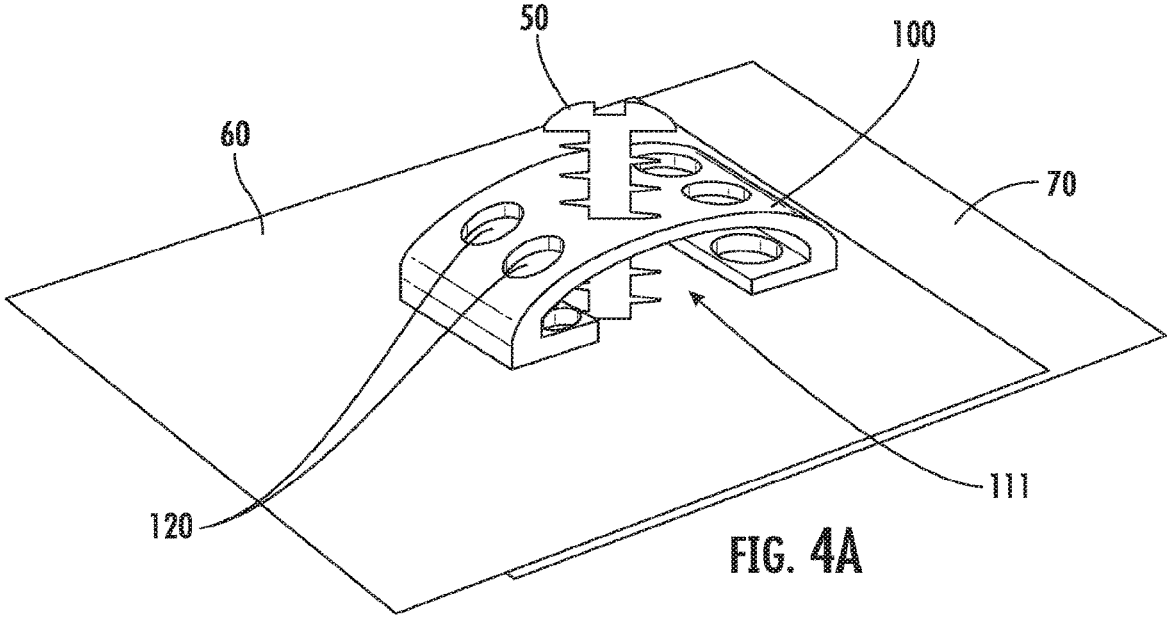
FIG. 4A is a top, perspective view of an alternate embodiment of a fastener plate in accordance with one or more aspects of the present disclosure.
Figure 4B:
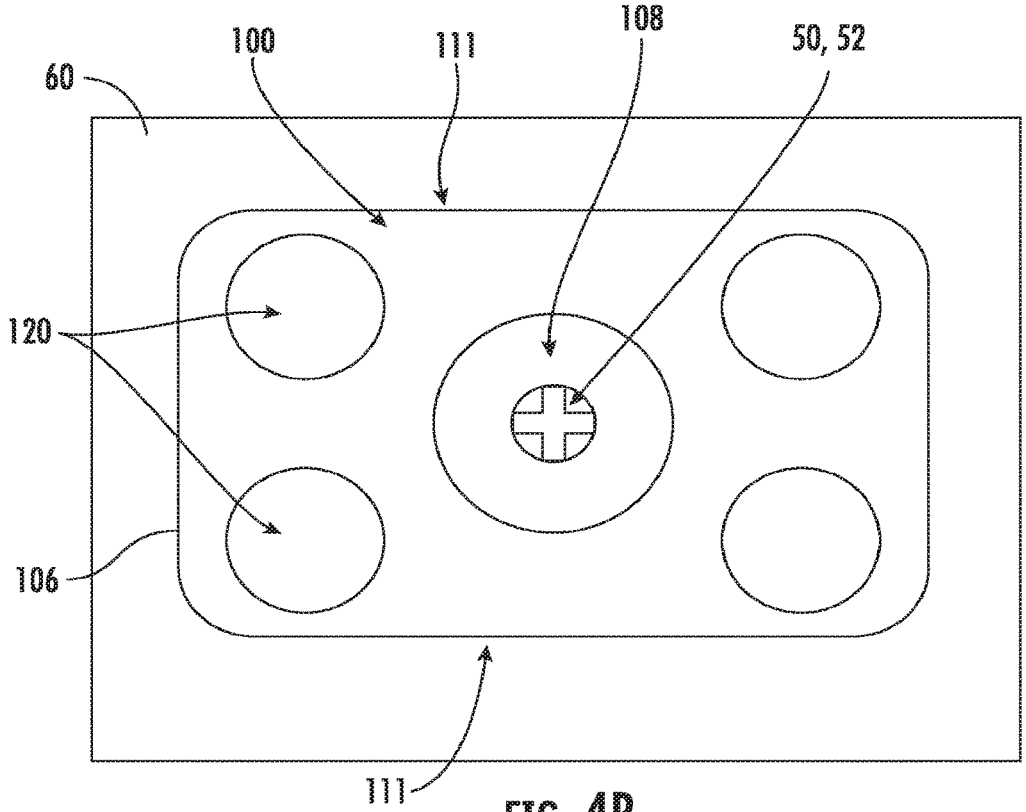
FIG. 4B is a top view of the fastener plate shown in FIG. 4A.

As previously mentioned, the fastener plate 100 may include any shape. For example, referring to FIGS. 4A and 4B, in one embodiment, the fastener plate 100 may include a rectangular shape. In one embodiment, when manufactured with a rectangular shape, the fastener plate 100 may include open side edges 111 (e.g., sides are completely open) to enable subsequently applied liquid coating 80 to flow there through. Thus arranged, in use, the rectangular shaped fastener block may be installed with the open side edges extending perpendicular to the direction of incoming wind to minimize edge cutting to the underneath structures caused by the wind lifting the plate.

Figure 5A:
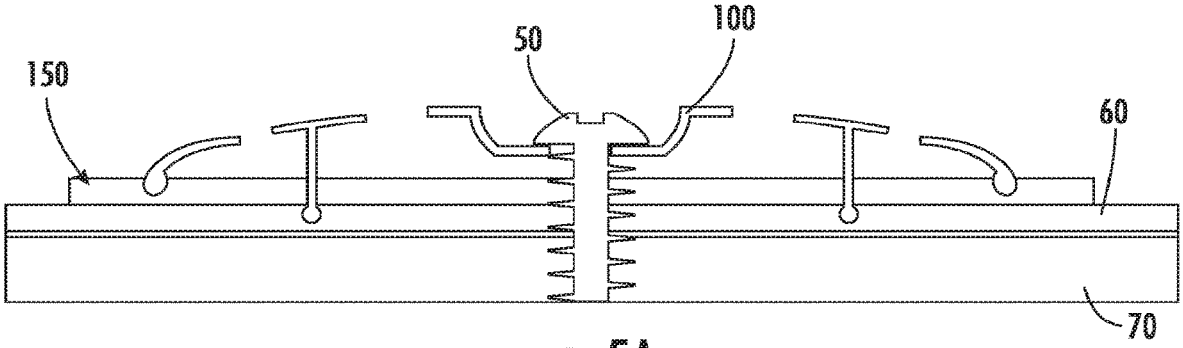
FIG. 5A is a cross-sectional view of an alternate embodiment of a fastener plate in accordance with one or more aspects of the present disclosure, the fastener plate including a layer of material coupled thereto.
Figure 5B:
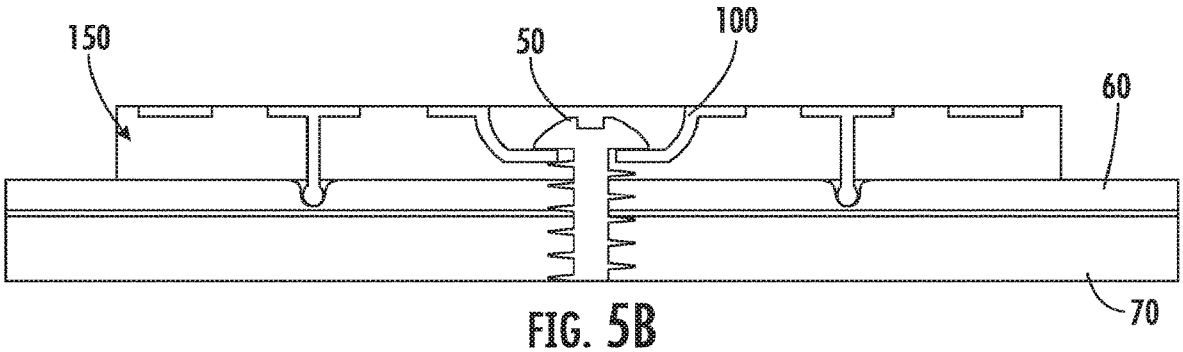
FIG. 5B is a cross-sectional view of an alternate embodiment of a fastener plate in accordance with one or more aspects of the present disclosure, the fastener plate including a layer of material coupled thereto.
Figure 5C:
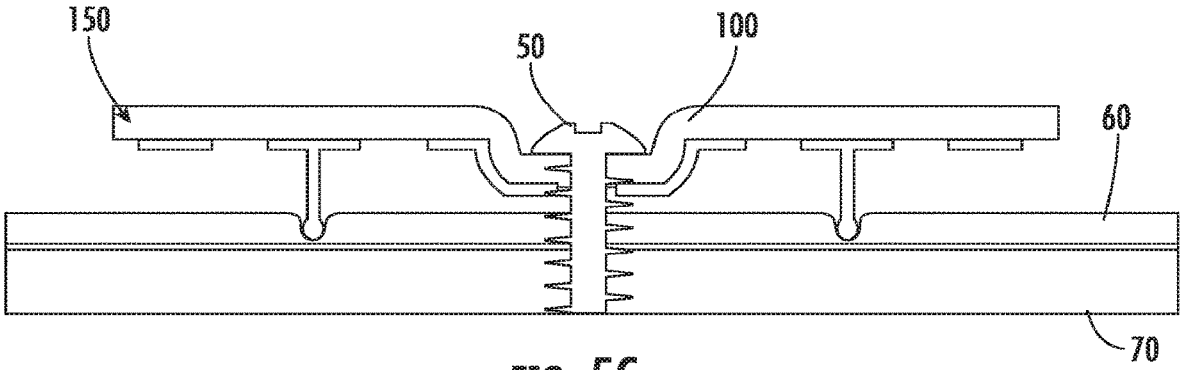
FIG. 5C is a cross-sectional view of an alternate embodiment of a fastener plate in accordance with one or more aspects of the present disclosure, the fastener plate including a layer of material coupled thereto.
Figure 6A:
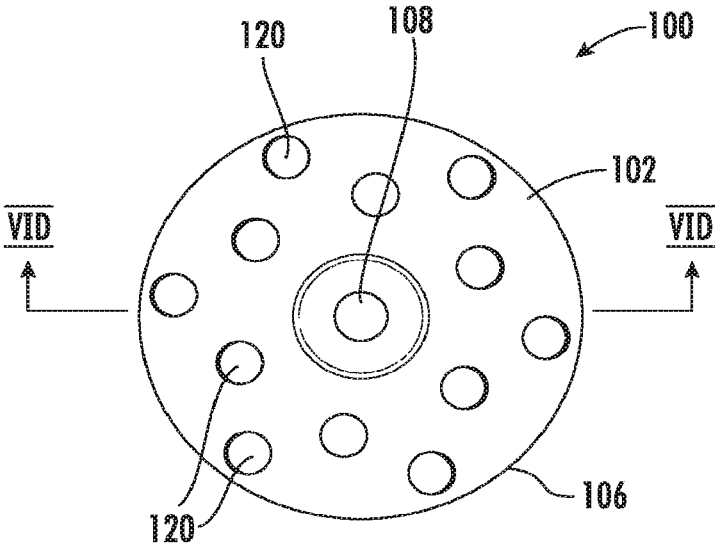
FIG. 6A is a top view of an alternate example of an embodiment of a fastener plate in accordance with one or more aspects of the present disclosure.
Figure 6B:
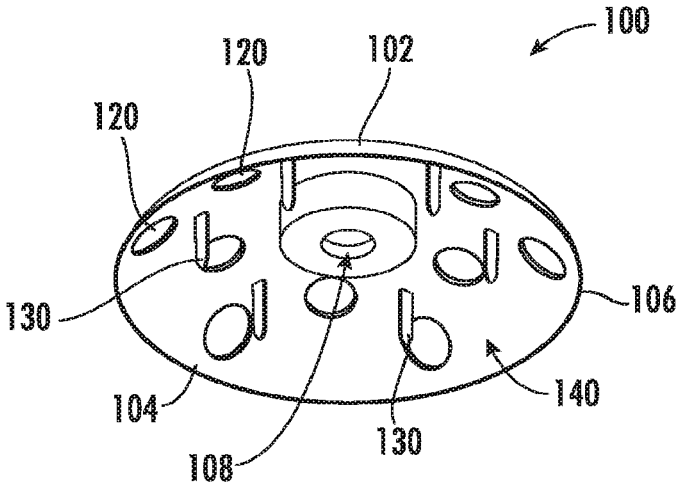
FIG. 6B is a bottom, perspective view of the fastener plate shown in FIG. 6A.
Figure 6C:
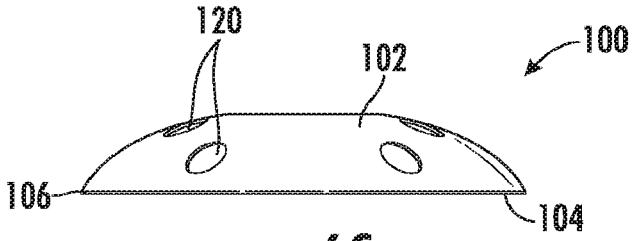
FIG. 6C is a side view of the fastener plate shown in FIG. 6A.
Figure 6D:
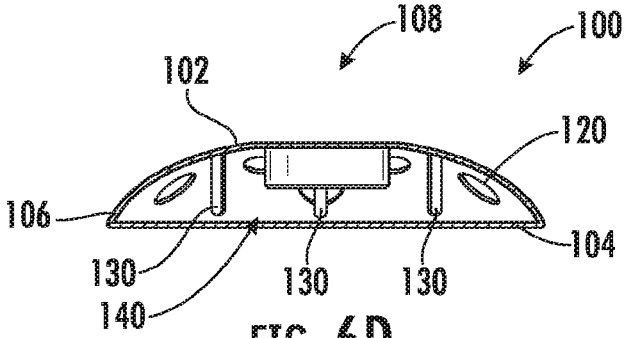
FIG. 6D is a cross-sectional view of the fastener plate shown in FIG. 6A, taken along line VID-VID in FIG. 6A.

Referring to FIGS. 5A-5C, in one embodiment, the fastener plate 100 may also include a thin layer of material 150 such as, for example, a mesh material. In use, the layer of material 150 may be secured to the fastener plate 100 such as, for example, via an adhesive. The layer of material 150 may be coupled underneath the fastener plate (FIGS. 5A and 5B), on top of the fastener plate 100 (FIG. 5C), or both. The layer of material 150 may encompass the entire area below the top surface 102 of the fastener plate 100 (FIG. 5B), or only some thereof (FIG. 5A). In use, the layer of material 150 provides a buffer padding thus eliminating, or at least minimizing, the potential of any sharp edges of the fastener plate 100 damaging, for example, the underlayment 60 or the top coating.

Referring to FIGS. 6A-6D, an example embodiment of an improved fastener plate 100 is disclosed. As will be shown and described, the fastener plate 100 is substantially similar to the fastener plates previously described. As previously described, in use, the fastener plate 100 can be used to couple an underlayment 60 (FIG. 1D) to a roof surface 70 (FIG. 1D). The fastener plate 100 may be arranged and configured with one or more features to enable subsequently applied liquid coating 80 (FIG. 1D) to pass through the fastener plate 100 to seal against the fastener 50 (FIG. 1D) used to couple the fastener plate 100 to the underlayment 60 and the roof surface 70.

As illustrated, the fastener plate 100 includes a top surface 102, a bottom surface (e.g., an underlayment contacting surface) 104, and an outer edge surface or perimeter 106. In use, the top surface 102 is spaced apart from the bottom surface 104 so that one or more cavities 140 are formed. As illustrated, the bottom surface 104 generally defines an open-ended bottom surface.

As shown, and as previously mentioned, the fastener plate 100 may include one or more fastener openings 108 in the top surface 102 thereof for receiving one or more fasteners 50, respectively, for securing the fastener plate 100 to the underlayment 60 and roof surface 70. As illustrated, the fastener opening 108 may be centrally positioned, although other configurations are envisioned (e.g., while a single fastener opening is disclosed and illustrated, the fastener plate may include multiple fastener openings. Additionally, the fastener openings may be located anywhere in the fastener plate). In use, the fastener opening 108 is arranged and configured to receive a fastener 50 to couple the fastener plate 100 to the underlayment 60 and roof surface 70. As shown, the fastener opening 108 may be countersunk so that, in use, an area above a head 52 of the fastener 50 may be sealed (e.g., covered) by subsequently applied liquid coating 80. In addition, the fastener opening 108 may be arranged and configured so that an area surrounding the head 52 of the fastener 50 is also sealed (e.g., covered) by subsequently applied liquid coating 80. In this manner, the entire area surrounding the fastener 50 may be sealed by subsequently applied liquid coating 80.

As illustrated, the fastener plate 100 includes a circular, domed shape, however, as previously mentioned, the fastener plate 100 may have any shape. By providing a dome shape, the fastener plate 100 includes a height in a center area adjacent to the fastener opening 108 that is greater than the height of the fastener plate 100 at the outer edge or perimeter 106 so that the center area (e.g., area where the fastener 50 passes through) is surrounded with a thicker layer of subsequently applied liquid coating 80.

In addition, as illustrated, the fastener plate 100 also includes a plurality of openings 120 extending through the top surface 102 thereof. In use, the openings 120 are sized and configured to enable subsequently applied coating 80 to pass through the fastener plate 100 and into contact with, for example, the fastener 50 and the underlayment 60. That is, the openings 120 may be arranged and configured to enable liquid coating 80 including, for example, silicone-based liquid coating, to flow sufficiently through the top surface 102 of the fastener plate 100 and into the cavity 140 formed therein. As illustrated, the openings 120 may be circular openings. However, the openings 120 may have any size and shape, and may be provided in any numbers and may be are arranged and configured in any manner to enable subsequently applied coating 80 to pass through the top surface 102 of the fastener plate 100 and into the cavity 140 formed underneath.

In addition, the fastener plate 100 may include a plurality of projections 130 extending from the top surface 102 thereof. In use, the projections 130 are arranged and configured to contact the underlayment 60 while preventing, or at least minimizing, compression of the fastener plate 100 (e.g., compressing of the top surface 102 towards the bottom surface 104) and thus closing or reducing of the cavity 140 formed therein during, for example, tightening of the fastener 50. Thus arranged, the projections 130 facilitate maintaining a desired height so that subsequently applied liquid coating 80 can flow into the cavity 140. In one embodiment, the projections 130 include a bottom edge adapted and configured to contact the underlayment 60 without cutting into or piercing the underlayment 60 during, for example, tightening of the fastener 50. As illustrated, when used with a circularly-shaped fastener plate, the projections 130 may be circumferentially disposed about an area of the plate 100.

By incorporating a plurality of openings 120, a plurality of projections 130, and one or more cavities 140, the fastener plate 100 is arranged and configured to enable subsequently applied liquid coating 80 to pass through the top surface 102 of the fastener plate 100 and into the cavity 140, where it may seal against the fastener 50 and the underlayment 60 thereby preventing, or at least minimizing, openings that enable the entry of moisture. In addition, by incorporating a countersunk fastener opening 108, the fastener plate 100 is arranged and configured to enable subsequently applied liquid coating 80 to cover and seal against the head 52 of the fastener 50. Thus arranged, the fastener plate 100 ensures efficient filling of the cavity 140 with the coating 80 and efficient filling of the pathway formed by the introduction of the fastener 50 into the underlayment 60 and the roof surface 70, thus ensuring proper sealing of the roof surface 70 from the introduction of moisture through the space created by the introduction of the fasteners 50.

Figure 7A:
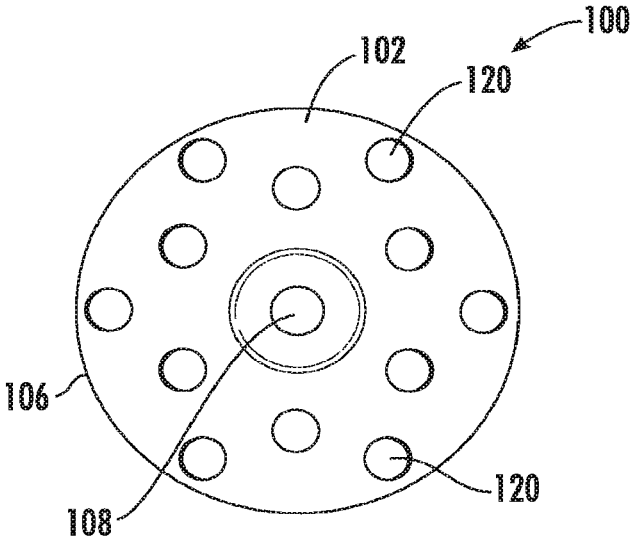
FIG. 7A is a top view of an alternate example of an embodiment of a fastener plate in accordance with one or more aspects of the present disclosure.
Figure 7B:
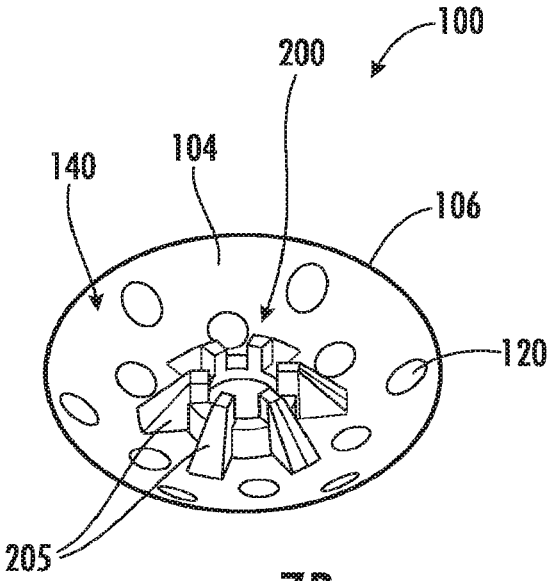
FIG. 7B is a bottom, perspective view of the fastener plate shown in FIG. 7A.

Referring to FIGS. 7A and 7B, an alternate, example embodiment of an improved fastener plate 100 is disclosed. The fastener plate 100 shown and described in connection with FIGS. 7A and 7B is substantially similar to the fastener plate shown and described in connection with FIGS. 6A-6D, thus, for the sake of brevity, only the differences are described herein.

As illustrated, the fastener plate 100 includes a stiffened or reinforced region 200 positioned about the centrally positioned, fastener opening 108. The stiffened region 200 is arranged and configured to prevent, or at least minimize, compressing of the fastener plate 100 and thus closing or reducing of the cavity 140 (e.g., prevents the top surface 102 adjacent to the center area from compressing towards the bottom surface 104). In use, the stiffened region 200 may take the place of, or be used in combination with, one or more projections 130 extending from the top surface 102 as previously described.

In use, the stiffened region 200 may have any structure and/or configuration arranged and configured to prevent, or at least minimize, compressing of the fastener plate 100 during tightening of the fastener 50. As illustrated, for example, the stiffened region 200 may include a plurality of projections 205 positioned circumferentially about the fastener opening 108. In use, the plurality of projections 205 are sufficiently rigid to prevent, or at least minimize, the top surface 102 from compressing due to tightening of a fastener 50 within the fastener opening 108.

Figure 8A:
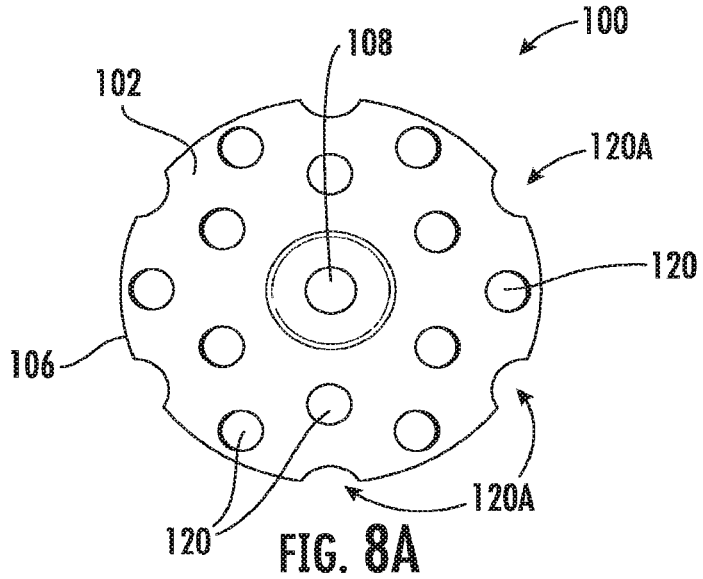
FIG. 8A is a top view of an alternate example of an embodiment of a fastener plate in accordance with one or more aspects of the present disclosure.
Figure 8B:
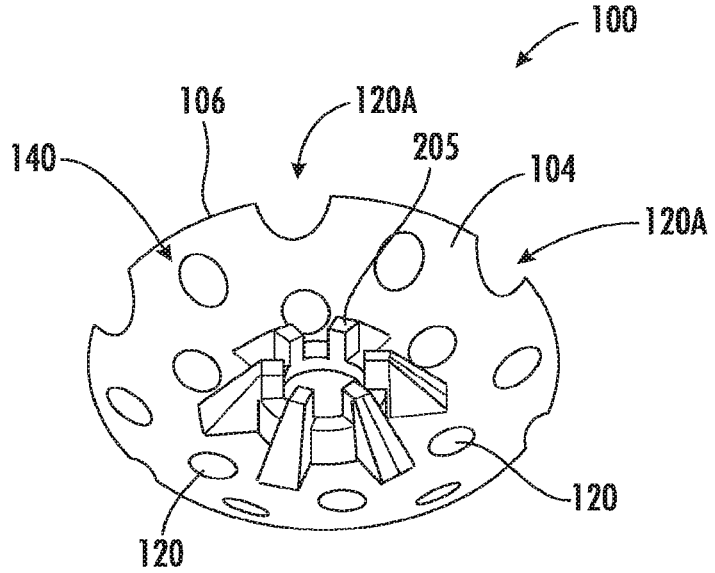
FIG. 8B is a bottom, perspective view of the fastener plate shown in FIG. 8A.
Figure 8C:
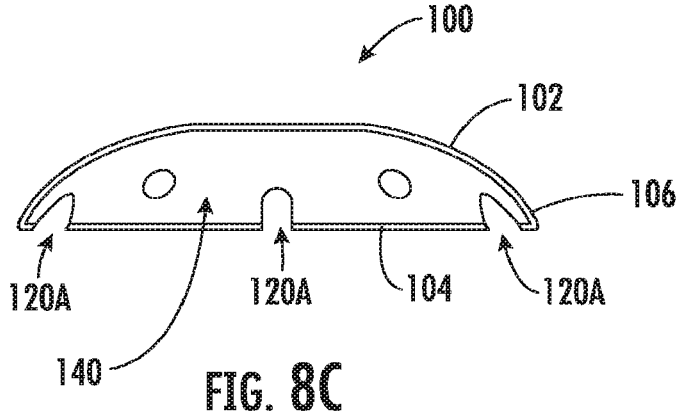
FIG. 8C is a side view of the fastener plate shown in FIG. 8A.

Referring to FIGS. 8A-8C, an alternate, example embodiment of an improved fastener plate 100 is disclosed. The fastener plate 100 shown and described in connection with FIGS. 8A-8C is substantially similar to the fastener plate shown and described in connection with FIGS. 7A and 7B, thus, for the sake of brevity, only the differences are described herein.

As illustrated, and as previously described, the fastener plate 100 includes a plurality of openings 120 extending through the top surface 102 thereof. In accordance with the present embodiment however, at least one or some of the plurality of openings 120A are positioned along the outer perimeter 106 of the fastener plate 100. By providing one or more openings 120A along, or in communication with, the outer perimeter 106 of the fastener plate 100, it has been discovered that increased fluid flow is obtained.

Figure 9A:
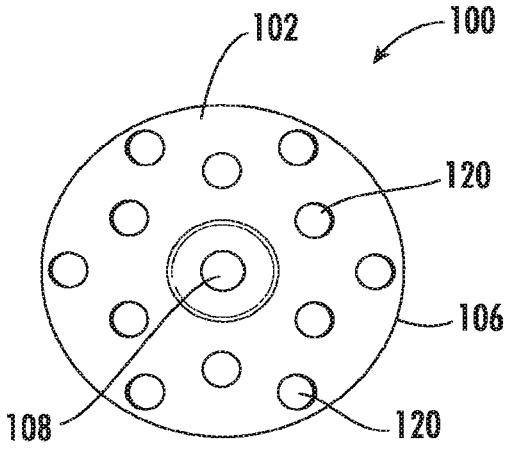
FIG. 9A is a top view of an alternate example of an embodiment of a fastener plate in accordance with one or more aspects of the present disclosure.
Figure 9B:
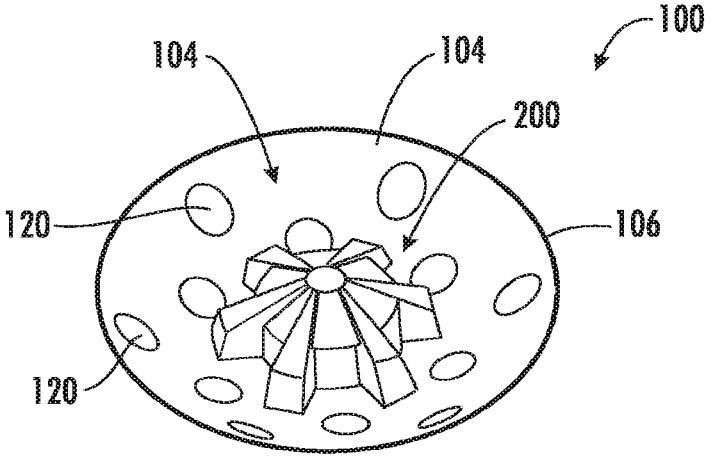
FIG. 9B is a bottom, perspective view of the fastener plate shown in FIG. 9A.
Figure 9C:
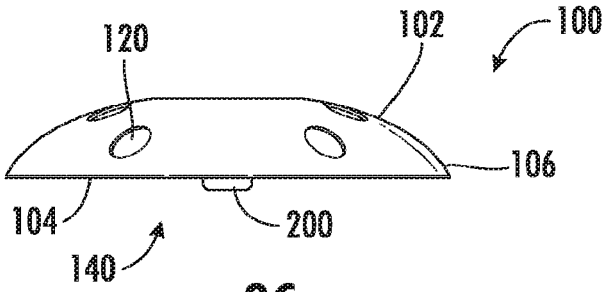
FIG. 9C is a side view of the fastener plate shown in FIG. 9A.

Referring to FIGS. 9A-9C, an alternate, example embodiment of an improved fastener plate 100 is disclosed. The fastener plate 100 shown and described in connection with FIGS. 9A-9C is substantially similar to the fastener plate shown and described in connection with FIGS. 7A-7B, thus, for the sake of brevity, only the differences are described herein.

As illustrated, the fastener plate 100 includes a stiffened or reinforced region 200 positioned about the centrally positioned, fastener opening 108. The stiffened region 200 is arranged and configured to prevent, or at least minimize, compressing of the fastener plate 100 and thus closing or reducing of the cavity 140 (e.g., prevents the top surface 102 adjacent to the center area from compressing towards the bottom surface 104). In use, the stiffened region 200 may take the place of, or be used in combination with, one or more projections 130 extending from the top surface 102.

As illustrated, in connection with the embodiment of FIGS. 9A-9C, the fastener plate 100 includes a stiffened region 200 positioned about the fastener opening 108. The stiffened region 200 including a plurality of projections 205 positioned circumferentially about the fastener opening 108. In use, the plurality of projections 205 are sufficiently rigid to prevent, or at least minimize, the top surface 102 from compressing due to tightening of a fastener 50 within the fastener opening 108. However, in connection with the present embodiment, the plurality of projections 205 extend below the bottom surface 104 of the fastener plate 100. Thus arranged, the plurality of projections 205 (e.g., center ring) is arranged and configured as a load bearing point. As such, the stiffened region 200 is adapted and configured to minimize torque on the fastener plate 100 during tightening.

Figure 2C:
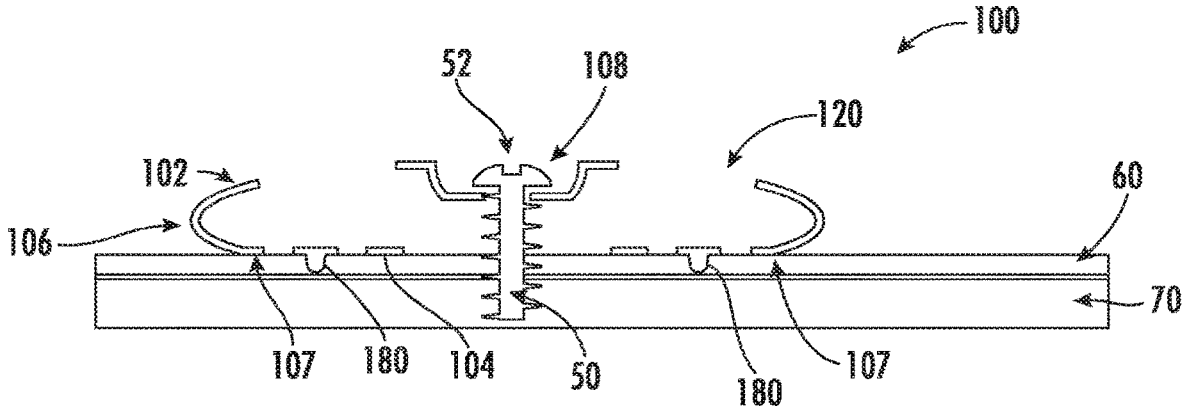
FIG. 2C is a cross-sectional view of the fastener plate shown in FIG. 2A, taken along line IIC-IIC in FIG. 2B.

The fastener plate 100 may be manufactured from any material now known or hereafter developed including, for example, metal, plastic, polymer, etc. In one embodiment, the fastener plate 100 may contain a certain amount of flexibility to enable the fastener plate 100 to flex and to prevent, or at least inhibit, sharp edges. Referring to FIG. 2C, in connection with a fastener plate 100 manufactured from metal, in one embodiment, the outer edge surface 106 may include an inwardly projecting lip 107 to prevent, or at least inhibit, the fastener plate 100 from cutting into the underlayment 60. Referring to FIGS. 3A and 3B in connection with a fastener plate 100 manufactured from plastic, in one embodiment, the outer edge surface 106 may include a rounded, spherical, flexible, etc. edge portion to prevent, or at least inhibit, the fastener plate 100 from cutting into the underlayment 60. As will be readily appreciated by one of ordinary skill in the art, the plastic fastener plate may include an inwardly projecting lip and the metal fastener plate may include a rounded edge portion. Moreover, other configurations are envisioned including, for example, straight edge portion.

The fastener plates 100 may be manufactured in any appropriate size. For example, in connection with circular designed fastener plates 100, the fastener plates 100 may include a diameter of 1 to 10 inches. In one embodiment, the fastener plates 100 may have a diameter of 2 to 4 inches. In one embodiment, the fastener plates 100 may have a diameter of 2 to 8 inches. In one embodiment, the fastener plates 100 may have a diameter of 2 to 6 inches. In one embodiment, the fastener plates 100 may have a diameter of 1 to 8 inches. In one embodiment, the fastener plates 100 may have a diameter of 1 to 6 inches.

In use, by incorporating a fastener plate 100 in accordance with one or more of the principles of the present disclosure, fastener plates 100 can be used to secure the underlayment 60 to the roof surface 70 even with, for example, silicone-based liquid applied coatings 80. That is, currently, when using a silicone-based liquid coating 80, fastener plates 100 are omitted because they do not enable enough silicone coating 80 to pass through the fastener plate to seal the opening created by introduction of the fastener 50. In contrast, in accordance with the principles of the fastener plates 100 disclosed herein, the fastener plates 100 enable sufficient flow through so that fastener plates 100 can be used even with, for example, silicone-based liquid coatings 80.

In use, in one embodiment, the underlayment 60 can be secured to the roof surface 70 using a plurality of fasteners 50 passing through a plurality of fastener plates 100, respectively. Thereafter, the liquid applied coating 80 can be installed over the underlayment 60 including over the fastener plates 100 and fasteners 50. The coating 80 flowing through the openings 120 formed in the fastener plates 100 and into the cavities 140 defined therein. In addition, the coating 80 flows into the fastener opening 108 and over and around the head 52 of the fastener 50. Thus arranged, the fastener 50 and the opening created by the introduction of the fastener 50 is sealed by the subsequently applied liquid coating 80. For best results, in use, the entire footprint of the fastener plates 100 may be covered by the subsequently applied liquid coating 80.

While the present disclosure refers to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The phrases "at least one", "one or more", and "and/or", as used herein, are open-ended expressions that are both conjunctive and disjunctive in operation. The terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. All rotational references describe relative movement between the various elements. Identification references (e.g., primary, secondary, first, second, third, fourth, etc.) are not intended to connote importance or priority but are used to distinguish one feature from another. The drawings are for purposes of illustration only and the dimensions, positions, order and relative to sizes reflected in the drawings attached hereto may vary.

What is claimed is:

1. A system, comprising:
a roofing substrate;
an underlayment located above the roofing substrate; and
a fastener plate located on the underlayment, the faster plate comprising:
a top plate comprising a top surface and a bottom surface,
wherein the top plate has an overall substantially dome-shaped cross-section;
a plurality of projections,
wherein the plurality of projections extends from the bottom surface of the top plate;
a fastener opening configured to receive a fastener,
wherein the fastener opening extends through the top plate; and
at least a first, a second, a third, and a fourth opening located in the top plate,
wherein when the fastener plate is on the roofing substrate,
the fastener plate defines an interior volume between the top plate and the roofing substrate, and
the first opening is in fluid communication, through the interior volume, with the second, third, and fourth openings,
the second opening is in fluid communication, through the interior volume, with the first, third, and fourth openings, the third opening is in fluid communication, through the interior volume, with the first, second, and fourth openings, and the fourth opening is in fluid communication, through the interior volume with the first, second, and third openings.

2. The system of claim 1, further comprising:
a fastener located in the fastener opening, through the underlayment, and into the roofing substrate.

3. The system of claim 1, further comprising:
a coating located on at least a portion of the top surface of the top plate and located within the interior volume defined by the fastener plate.

4. The system of claim 3, wherein the coating comprises a silicone coating.

5. The system of claim 1, wherein at least one projection of the plurality of projections comprises a rounded edge portion.

6. The system of claim 1, wherein the plurality of projections comprises:
a first circumferentially disposed set of projections, and
a second circumferentially disposed set of projections.

7. The system of claim 1, wherein at least one of the first opening, the second opening, the third opening, and the fourth opening located is located along an outer perimeter of the fastener top plate.

8. The system of claim 1, wherein at least one projection of the plurality of projections contacts the roofing substrate.

9. The system of claim 1, wherein at least some projections of the plurality of projections are located circumferentially about the fastener opening.

10. The system of claim 1, wherein the roofing substrate is a roof deck.

11. A system, comprising:
a roofing substrate;
an underlayment located above the roofing substrate; and
a fastener plate located on the underlayment, the faster plate comprising:
a top plate comprising a top surface and a bottom surface,
wherein the top plate has an overall substantially dome-shaped cross-section;
a plurality of projections,
wherein the plurality of projections extends from the bottom surface of the top plate;
a fastener opening configured to receive a fastener,
wherein the fastener opening extends through the top plate; and
a plurality of openings located in the top plate,
wherein the plurality of openings comprises at least a first, a second, a third, and a fourth opening located in the top plate, and
wherein when the fastener plate is on the roofing substrate,
the fastener plate defines an interior volume between the top plate and the roofing substrate, and
the first opening is in fluid communication, through the interior volume, with the second, third, and fourth openings,
the second opening is in fluid communication, through the interior volume, with the first, third, and fourth openings, the third opening is in fluid communication, through the interior volume, with the first, second, and fourth openings, and the fourth opening is in fluid communication, through the interior volume with the first, second, and third openings, and
wherein a total cumulative area of the plurality of openings is from 10% to 90% of a total surface area of the top surface of the top plate.

12. The system of claim 11, further comprising:
a fastener located in the fastener opening, through the underlayment, and into the roofing substrate.

13. The system of claim 11, further comprising:
a coating located on at least a portion of the top surface of the top plate and located within the interior volume defined by the fastener plate.

14. The system of claim 13, wherein the coating comprises a silicone coating.

15. The system of claim 11, wherein at least one projection of the plurality of projections comprises a rounded edge portion.

16. The system of claim 11, wherein the plurality of projections comprises:
a first circumferentially disposed set of projections, and
a second circumferentially disposed set of projections.

17. The system of claim 11, wherein at least one of the first opening, the second opening, the third opening, and the fourth opening located in the top surface is located along an outer perimeter of the fastener top plate.

18. The system of claim 11, wherein at least one projection of the plurality of projections contacts the roofing substrate.

19. The system of claim 11, wherein at least some projections of the plurality of projections are located circumferentially about the fastener opening.

20. The system of claim 11, wherein the roofing substrate is a roof deck.

* * * * *